US010595612B2

(12) United States Patent
Brown

(10) Patent No.: US 10,595,612 B2
(45) Date of Patent: Mar. 24, 2020

(54) GLOVE FOR FACIAL TREATMENT

(71) Applicant: Phinazee Brown, Atlanta, GA (US)

(72) Inventor: Phinazee Brown, Atlanta, GA (US)

( * ) Notice: Subject to any disclaimer, the term of this patent is extended or adjusted under 35 U.S.C. 154(b) by 50 days.

(21) Appl. No.: 15/964,354

(22) Filed: Apr. 27, 2018

(65) Prior Publication Data

US 2019/0328107 A1 Oct. 31, 2019

(51) Int. Cl.

| | |
|---|---|
| ***A45D 34/04*** | (2006.01) |
| ***A41D 19/00*** | (2006.01) |
| ***A46B 5/04*** | (2006.01) |
| ***A46B 11/00*** | (2006.01) |

(52) U.S. Cl.

CPC ..... *A45D 34/042* (2013.01); *A41D 19/0024* (2013.01); *A46B 5/04* (2013.01); *A46B 11/0062* (2013.01); *A46B 11/0079* (2013.01); *A41D 2400/48* (2013.01); *A45D 2200/05* (2013.01); *A45D 2200/1018* (2013.01)

(58) Field of Classification Search

None

See application file for complete search history.

(56) References Cited

U.S. PATENT DOCUMENTS

| | | | | |
|---|---|---|---|---|
| 6,513,998 B1 * | 2/2003 | Barry | A41D 19/0079 | 401/196 |
| 2007/0028357 A1 * | 2/2007 | Adams, Jr. | A63B 21/045 | 2/163 |
| 2015/0157071 A1 * | 6/2015 | Adams | A46B 5/04 | 2/160 |

OTHER PUBLICATIONS

Burmax www.burmax.com/products.asp?cat1=D0&cat2=U0 2010 2 pages (Year: 2010).*

* cited by examiner

*Primary Examiner* — Robert A Wax
*Assistant Examiner* — Caralynne E Helm
(74) *Attorney, Agent, or Firm* — Sanchelima & Associates, P.A.; Christian Sanchelima; Jesus Sanchelima

(57) ABSTRACT

A glove used for facial treatment is disclosed herein. The glove includes a hand opening, finger portions, a palm region, and at least one cosmetic pocket or cavity, at least one cap and at least one scrubbing pad. A User wears the glove on their hand and applies different types of cosmetic solutions to their skin that are filled into the cosmetic pockets or cavities located within the hollow finger portions of the glove. The caps of the cosmetic pockets can be opened to fill a cosmetic solution into the cavities and sealed to secure the cosmetic solution within said finger portions. At least a portion of glove, mainly a palm portion, is provided with at least one scrubbing pad that facilitates scrubbing and thus reduces clogged pores and puffiness. As a result, the glove facilitates facial treatment in a user friendly manner.

5 Claims, 3 Drawing Sheets

GLOVE FOR FACIAL TREATMENT

BACKGROUND OF THE INVENTION

1. Field of the Invention

The present disclosure relates to a hand glove for use during hygiene care. More particularly, the present disclosure relates to a hand glove that facilitates facial cleaning/treatment.

2. Description of the Related Art

Caring of skin, especially facial skin, is indeed important as it reflects a person's personality. However, performing facial or like other face related treatments by using hands can be irritating because of stickiness and oiliness of cosmetics. Also, while changing cosmetics, one need to first wash hands to remove the first cosmetic and then apply another on washed hands. Further, each time cosmetics are required to be removed from different cosmetic tubes/containers. Such activities of washing, applying or removing from different tubes are tedious and time-consuming. Also, by use of hands one cannot perform scrubbing treatment and hence a scrubber is additionally required for scrubbing facial skin. Usage of cosmetics directly by hands can cause allergic reactions because of sensitive skin.

Several designs of various cosmetics applying tools have been designed in the past. None of them, however, include a hand glove that protect hand from oiliness and stickiness of cosmetics and allergies caused thereby, facilitates storage and ejection of different cosmetics and facilitates scrubbing.

Applicant believes that a related reference corresponds to US patent application 20160128521 filed by Makeup Eraser Group LLC titled 'Facial cleaning pad' disclose a body constructed from a pliant fabric and having opposed first a long pile knit finish and second surfaces having a warp knit finish. However, the facial cleaning pad can only be utilized for removing applied make-up on face and while removing make-up it is likely that the facial cleaning pad may slip and fall off.

Another US patent 20030215486 filed by Acupac Packaging Inc. titled 'Cleansing or moisturizing mitt or glove' discloses a first substrate coated with one cosmetic formulation and a second substrate also coated with one cosmetic formulation. However, the glove being utilized as a scrubber is not explicitly mentioned.

Other documents describing the closest subject matter provide for a number of more or less complicated features that fail to solve the problem in an efficient and economical way. None of these patents suggest the novel features of the present invention.

SUMMARY OF THE INVENTION

In view of the above, it is an objective of the present invention to solve or at least reduce the problems discussed above. The present invention is a glove that is used for facial treatment. The glove includes a hand opening, at least one cosmetic pocket, at least one cap and at least one scrubbing pad. User wears glove on hand through hand opening. Different types of cosmetics are filled in the cosmetic pocket which is provided at the finger portions of glove. Caps of cosmetic pocket can be opened to fill cosmetics in cosmetic pocket and sealed to secure cosmetics therewithin cosmetic pocket. At least a portion of glove, mainly a palm region, is provided with at least one scrubbing pad which facilitates scrubbing for performing facial treatment.

It is one of the main objects of the present invention is to provide a hand wearable glove that facilitates storage and ejection of cosmetics, scrubbing and protects hand from stickiness, oiliness and allergic reactions of cosmetics.

It is another object of this invention is to provide a glove that facilitates complete facial or face related treatment at home without slippage from hand.

It is another object of this invention is to provide a glove that enhances comfort and relaxation.

It is another object of this invention is to provide a glove that reduces clogged pores and puffiness.

It is another object of this invention is to provide a glove that is convenient, user-friendly and easy to use.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 1:
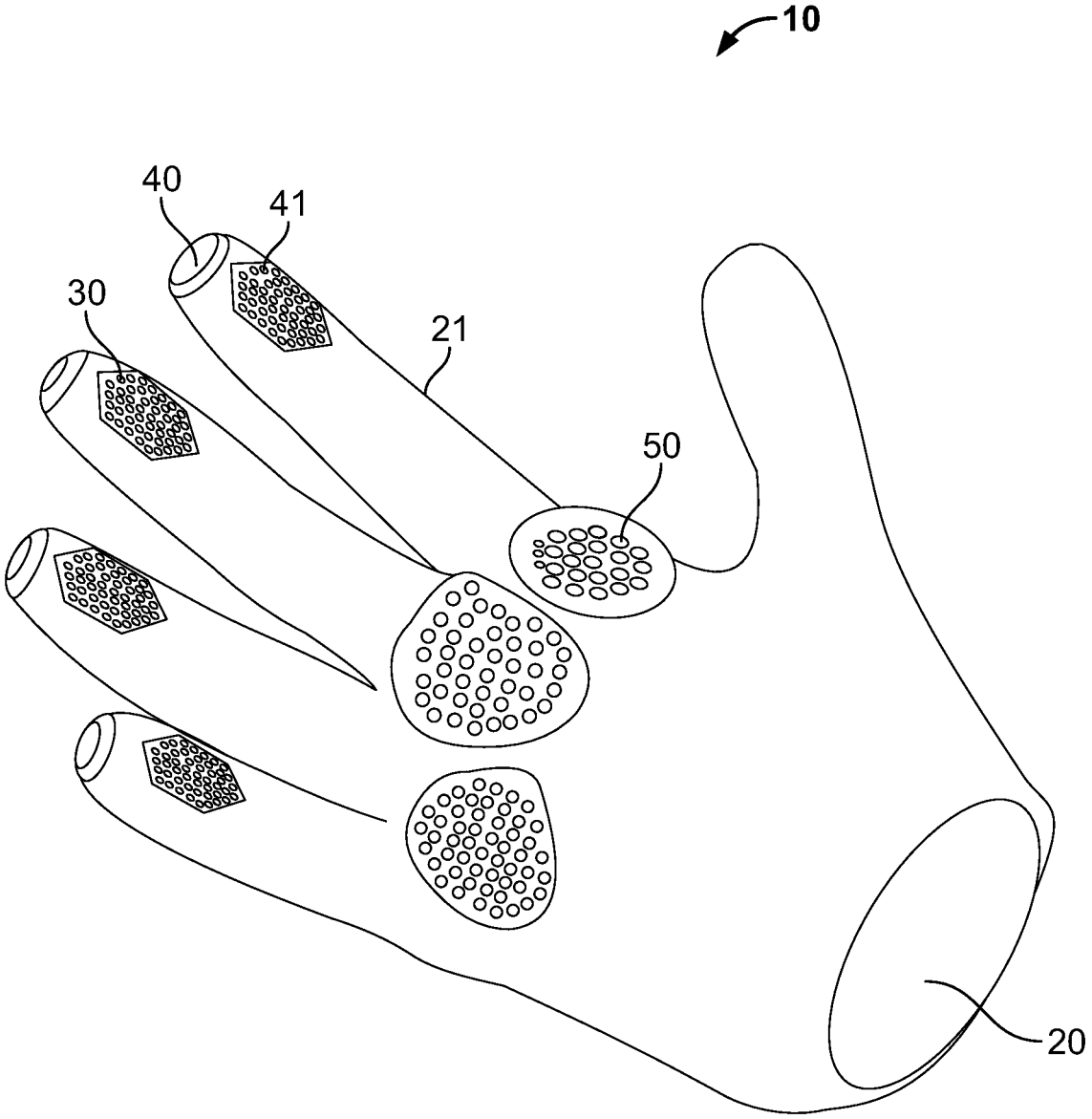
FIG. 1 represents a perspective view of a glove for facial treatment, in accordance with one embodiment of the present invention.
Figure 2:
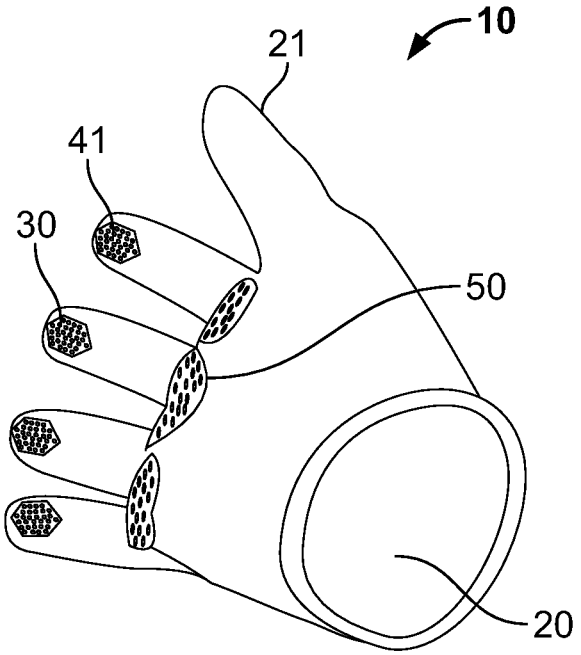
FIG. 2 is a perspective bottom view of glove of FIG. 1.
Figure 3:
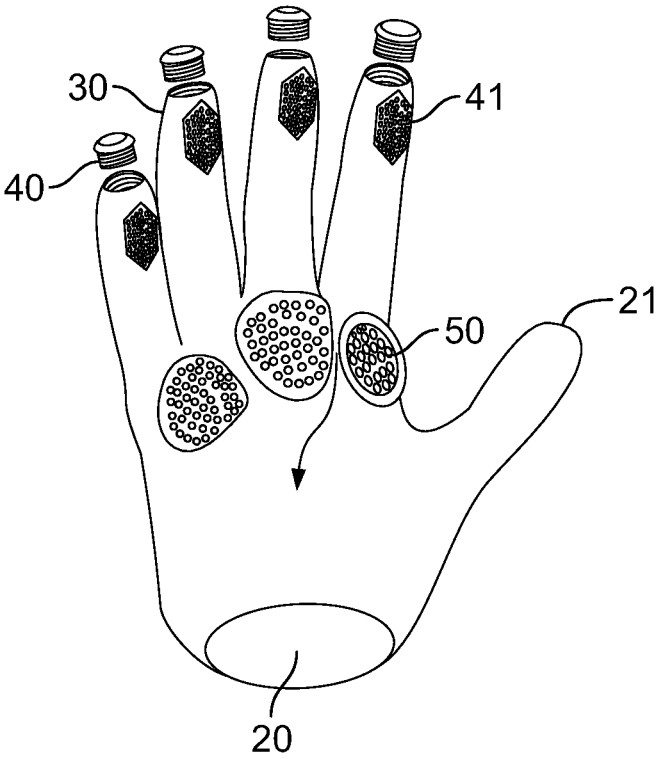
FIG. 3 represents an exploded view of glove of FIG. 1.

Referring now to the drawings (FIGS. 1 to 5), where the present invention is generally referred to with numeral 10, it can be observed that a glove for facial treatment, in accordance with one embodiment, is provided that includes a hand opening 20, at least one cosmetic pocket 30, at least one cap 40 and at least one scrubbing pad 50.

Hand opening 20 facilitates inserting a hand to wear glove 10 and removal of a hand from glove 10 after use.

Figure 4:
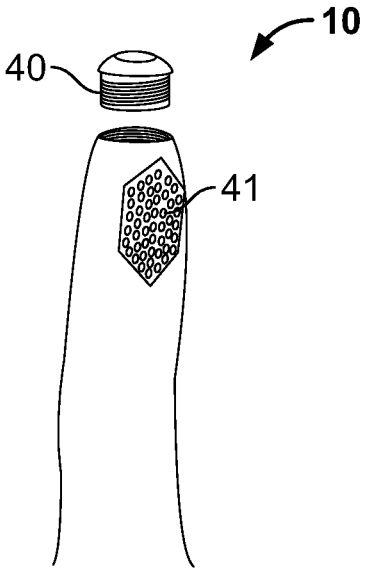
FIG. 4 represents an enlarged view of a finger with glove of FIG. 1, fitted with a cap.
Figure 5:
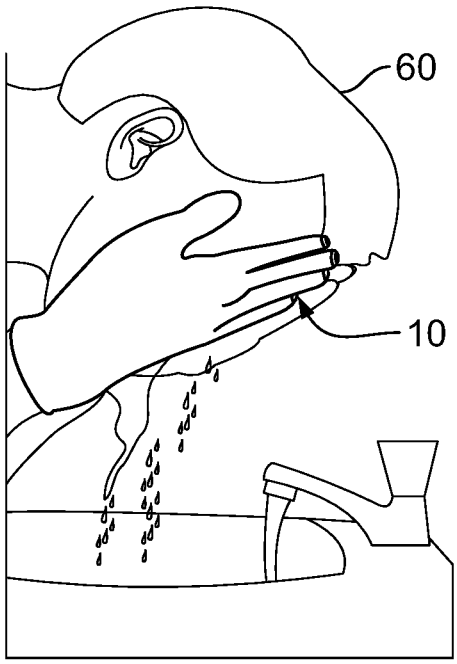
FIG. 5 represents the glove of FIG. 1 used by a user.

Hand gloves 10 are provided with finger portions 21 in which fingers are inserted. Finger portions 21 are provided with cosmetic pockets/cavities 30 at the distal ends in which cosmetics like solution, oil, creams, mild soaps, witch hazel and like others are filled via a circular opening in the cosmetic pocket located at the top most end of a finger portion. After filling of cosmetics in cosmetic pockets 30, finger portions 21 are enclosed by using caps 40. In one embodiment, cosmetics can be removed by opening caps 40. Caps 40 can be press fitted with or screwed to cosmetic pockets 30 or by other techniques such that cosmetics filled in cosmetic pockets is sealed and thus prevented from being leaked. In another embodiment, cosmetics can be removed from holes 41 configured on cosmetic pockets 30. Holes 41 provide fluid connection between the cosmetic pocket and the palm region. Moreover, cosmetics can be removed by pressing cosmetic pockets 30 either by hand or is removed by scrubbing/pressing finger portions 21 over face or other body area. As seen in FIG. 4, caps 40 fit into the opening at the end of cosmetic pockets 30 via a screw mechanism. Wherein an inner portion of the glove 10 within cosmetic pockets 30 can be seen having inner threads. Additionally, caps 40 include outer threads that are able to receive the inner threads of the cap and permit the cosmetic pockets to be sealed within glove 10. As further seen in FIG. 4, caps 40 includes a top portion and a bottom portion. The bottom portion of the cap is cylindrical in shape and includes the outer threads thereon. Furthermore, the top portion of the cap may be semi-spherical in shape and include a flat portion at a topmost end of the top portion.

Scrubbing pads 50 are provided on at least a portion of the palm region of glove 10. In one embodiment, a number of scrubbing pads 50 are provided that facilitate scrubbing while moving the palm region on the face. For instance, as illustrated in FIG. 1, three scrubbing pads 50 are provided under finger portions 21. However, the number of scrubbing pads 50 can be varied and position can be also varied. Though, scrubbing pads 50 are provided under finger portions 21, scrubbing pads 50 can be provided on at least a finger portion 21 or anywhere on palm region of glove 10. In another embodiment, one scrubbing pad 50 of desired size is provided that can facilitate scrubbing. Material of scrubbing pad 50 can be varied and selected as per requirement. As seen in FIG. 1, a palm region of finger portion 21 may have a hexagonal portion located thereon. In one embodiment, this hexagonal portion may be made of an exfoliating material and include holes 41 within its area.

In operation, user 60 can wear glove 10 and apply, on user's face, cosmetics, such as mild soap, filled in one of cosmetic pocket 30 and then clean face with lukewarm water followed by cold water. User 60 can then wipe face with a towel. User 60 can spread, from various cosmetic pockets 30, cosmetics, like witch hazel in upper direction on face and then apply mineral oil in circular direction and dry for specific time duration. Scrubbing pads 50 can be used for cleaning clogged pores and exfoliate skin. Glove 10 is thus convenient, user-friendly and easy to use and provides comfort and relaxation. Glove 10 can be worn in one hand or both hands of user 60. As glove 10 is wearable on the hand, there is no slipping of glove 10 and also provides proper gripping while in use. Glove 10 thus facilitates complete facial or face related treatment at home. Glove 10 can be used not only for treatment of user's face but also can be used on other body parts. Glove 10 is easy to use by men however can be used by females as well.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A glove for facial treatment, comprising: a glove having finger portions and a region below said finger portions that together are adapted to receive a user's entire hand, wherein said glove has a palm region that includes at least one scrubbing pad and at least one of said finger portions includes a cavity therein, that is located at the distal end of said finger portion, said cavity includes an opening that is circular in shape and located at a top most end of said finger portion and a cap to cover said opening, said cap includes a top portion and a bottom portion, wherein said bottom portion of said cap is cylindrical in shape and includes outer threads, wherein said top portion of said cap is semi-spherical in shape and includes a flat portion at a topmost end of said top portion, said opening includes an inner surface area with inner threads located thereon, said bottom portion of said cap is inserted within said opening such that said outer threads receive said inner threads to seal said cavity, said cavity is adapted to receive a cosmetic and includes a plurality of small openings on the palm region of the finger portion that are adapted to release said cosmetic onto a user's skin.

2. The glove of claim 1 wherein said palm region includes three scrubbing pads aligned laterally and includes a spacing between them.

3. The glove of claim 1 wherein said at least one scrubbing pad is located on said finger portion.

4. The glove of claim 1 wherein said at least one scrubbing pad is adapted to exfoliate a user's skin.

5. The glove of claim 1, wherein each of said finger portions includes said cavity and said cap.

* * * * *